US005376286A

United States Patent [19]

Vogel et al.

[11] Patent Number: 5,376,286

[45] Date of Patent: Dec. 27, 1994

[54] PROCESS FOR PREPARING CONCENTRATED IMIDAZOLINE FABRIC SOFTENER COMPOSITIONS

[75] Inventors: ALice M. Vogel; John C. Severns, both of West Chester; Troy L. Nimrick, Cincinnati, all of Ohio

[73] Assignee: The Procter & Gamble Company, Cincinnati, Ohio

[21] Appl. No.: 127,965

[22] Filed: Sep. 28, 1993

Related U.S. Application Data

[63] Continuation of Ser. No. 851,605, Mar. 16, 1992, abandoned.

[51] Int. Cl.[5] ..... C11D 1/40

[52] U.S. Cl. ..... 252/8.6; 252/8.8; 252/8.9

[58] Field of Search ..... 252/8.6, 8.8, 8.9; 548/350.1, 352.1

[56] References Cited

U.S. PATENT DOCUMENTS

| | | | |
|---|---|---|---|
| 3,980,682 | 9/1976 | Danner | 252/8.7 |
| 4,233,164 | 11/1980 | Davis | 252/8.8 |
| 4,360,437 | 11/1982 | Wolfes | 252/8.8 |
| 4,439,330 | 3/1984 | Ooms | 252/8.8 |
| 4,476,031 | 10/1984 | Ooms | 252/8.8 |
| 4,661,267 | 4/1987 | Dekker et al. | 252/8.8 |
| 4,724,089 | 2/1988 | Konig et al. | 252/8.8 |
| 4,756,850 | 7/1988 | Nayar | 252/8.8 |
| 4,789,491 | 12/1988 | Chang et al. | 252/8.75 |
| 4,806,255 | 2/1989 | Konig et al. | 252/8.8 |
| 4,808,321 | 2/1989 | Walley | 252/8.8 |
| 4,876,355 | 10/1989 | Hughes et al. | 548/352 |
| 4,933,096 | 6/1990 | Demeyere et al. | 252/8.8 |
| 4,954,270 | 9/1990 | Butterworth et al. | 252/8.8 |
| 4,965,100 | 10/1990 | Leigh et al. | 427/242 |
| 4,999,121 | 3/1991 | De Block et al. | 252/8.8 |
| 5,061,385 | 10/1991 | Duffin | 252/8.8 |
| 5,116,520 | 5/1992 | Lichtenwalter et al. | 252/8.8 |
| 5,154,841 | 10/1992 | Tucker et al. | 252/8.8 |

FOREIGN PATENT DOCUMENTS

| | | |
|---|---|---|
| 0239910 | 10/1987 | European Pat. Off. . |
| 0345842 | 12/1989 | European Pat. Off. . |
| 0404471 | 12/1990 | European Pat. Off. . |
| 0409503A2 | 1/1991 | European Pat. Off. . |
| 3312328-A | 10/1984 | Germany . |
| 1565808 | 4/1980 | United Kingdom . |

*Primary Examiner*—Mark L. Bell
*Assistant Examiner*—C. M. Bonnar
*Attorney, Agent, or Firm*—Betty J. Zea; Robert B. Aylor

[57] ABSTRACT

A three-step method for preparing textile treatment compositions comprising mixtures of substituted imidazoline fabric softener materials and protonating acids is provided. In Step (1) the imidazoline is heated, and in Step (2) it is protonated in a concentrated acid/water seat. Step (3) comprises diluting this mixture with additional water. Utilizing this method provides compositions having good product stability, dispersibility, and concentratability, as well as excellent fabric softening characteristics.

18 Claims, No Drawings

PROCESS FOR PREPARING CONCENTRATED IMIDAZOLINE FABRIC SOFTENER COMPOSITIONS

This is a continuation of application Ser. No. 07/851,605, filed on Mar. 16, 1992, now abandoned.

TECHNICAL FIELD

The present invention relates to a method for preparing textile treatment compositions. In particular, it relates to a method of preparing textile treatment compositions for use in the rinse cycle of a textile laundering operation to provide fabric softening/static control benefits. This method provides compositions characterized by excellent storage stability, softening performance, and preferably biodegradability. The compositions herein can also be used to treat fabrics in hot air clothes dryers and in hair conditioning compositions.

BACKGROUND OF THE INVENTION

Textile treatment compositions suitable for providing fabric softening and static control benefits during laundering are well-known in the art and have found wide-scale commercial application. Conventionally, rinse-added fabric softening compositions contain, as the active softening component, substantially water-insoluble cationic materials having two long alkyl chains. Typical of such materials are ditallow alkyl dimethyl ammonium chloride and imidazolinium compounds substituted with two stearyl or tallow alkyl groups. These materials are normally prepared in the form of a dispersion in water.

The use of various imidazoline derivatives as fabric conditioning agents is known. For example, British Patent Specification 1,565,808, published Apr. 23, 1980, discloses textile fabric softener compositions consisting of an aqueous dispersion of imidazoline ester derivatives. Similarly, methods for preparing various imidazoline derivatives are known in the art. See for example, U.S. Pat. No. 4,233,451, Pracht, issued Nov. 11, 1980, U.S. Pat. No. 4,189,593, Wechsler et al., issued Feb. 19, 1980, and Japanese Laid Open Publication 61-291571.

Various solutions to the problem of preparing concentrated fabric softening compositions suitable for consumer use have been addressed in the art. See, for example, U.S. Pat. Nos.: 4,426,299, issued Jan. 17, 1984, and 4,401,578, issued Aug. 30, 1983, Verbruggen, which relate to paraffin, fatty acids and ester extenders in softener concentrates as viscosity control agents.

European Pat. No. 0,018,039, Clint et al., issued Mar. 7, 1984, relates to hydrocarbons plus soluble cationic or nonionic surfactants in softener concentrates to improve viscosity and stability characteristics.

U.S. Pat. No. 4,454,049, MacGilp et al., issued Jun. 12, 1984, discloses concentrated liquid textile treatment compositions in the form of isotropic solutions comprising water-insoluble di-$C_{16}$–$C_{24}$ optionally hydroxy-substituted alkyl, alkaryl or alkenyl cationic fabric softeners, at least about 70% of the fabric softener consisting of one or more components together having a melting completion temperature of less than about 20° C., a water-insoluble nonionic extender, especially $C_{10}$–$C_{40}$ hydrocarbons or esters of mono- or polyhydric alcohols with $C_8$–$C_{24}$ fatty acids, and a water-miscible organic solvent. The concentrates have improved formulation stability and dispersibility, combined with excellent fabric softening characteristics.

U.S. Pat. No. 4,439,330, Ooms, issued Hat. 27, 1984, teaches concentrated fabric softeners comprising ethoxylated amines.

U.S. Pat. No. 4,476,031, Ooms, issued Oct. 9, 1984, teaches ethoxylated amines or protonated derivatives thereof, in combination with ammonium, imidazolinium, and like materials.

The use of alkoxylated amines, as a class, in softener compositions is known (see, for example, German Patent Applications 2,829,022, Jakobi and Schmadel, published Jan. 10, 1980, and 1,619,043, Hueller et al., published Oct. 30, 1969, and U.S. Pat. Nos.: 4,076,632, Davis, issued Feb. 28, 1978, and 4,157,307, Jaeger et al., issued June 5, 1979).

It is generally known (for example, in U.S. Pat. No. 3,681,241, Rudy, issued Aug. 1, 1972) that the presence of ionizable salts in softener compositions does help reduce viscosity.

Copending U.S. Pat. Application Set. No. 07/693,493, Vogel, Watson, Wahl and Benvegnu, filed Apr. 30, 1991, teaches softening compositions containing imidazoline mixtures with ethoxylated materials as scum dispersants.

The prior art generally discloses that amines, and especially imidazolines, used in fabric softening compositions preferably should be protonated with hydrochloric acid (HCl), orthophosphoric acid (OPA) $C_1$ to $C_5$ carboxylic acids or other similar acids for use in fabric softening compositions. (See e.g., U.S. Pat. No. 4,965,100, Leigh et al., issued Oct. 23, 1990; U.S. Pat. No. 4,954,270, Butterworth et al., issued Sept. 4, 1990; U.S. Pat. No. 4,360,437, Wolfes, issued Nov. 23, 1982; U.S. Pat. No. 4,233,164, Davis, issued Nov. 11, 1980; and U.S. Pat. No. 4,876,355, Hughes et al., issued Oct. 24, 1989.)

U.S. Pat. No. 4,808,321, Walley, issued Feb. 28, 1989, teaches fabric softening compositions comprising a quaternary ammonium compound at pH of from 2 to 5, which are free of unprotonated amines or where the amines are protonated with strong acids to enhance hydrolytic stability of the composition.

U.S. Pat. No. 4,789,491, Chang et al., issued Dec. 6, 1988, teaches a method of making stable compositions with quaternized di-esters or di-isopropanol amines using narrow pH and temperature ranges.

U.S. Pat. No. 5,061,385, Duffin, issued Oct. 29, 1991, discloses a rinse cycle fabric-treatment composition containing imidazolines. The composition is prepared by adding water to a molten premix of active materials to form a water-in-oil emulsion. Upon further addition of water this phase is reversed to a finely dispersed oil-in-water emulsion. The pH of the composition is between 2 and 7, preferably from 3 to 4.5.

U.S. Pat. No. 4,933,096, Demeyere et al., issued Jun. 12, 1990, discloses a textile treatment composition comprising 1–40% imidazoline and a dispersing acid, having good hydrolytic stability and low viscosity. In a one-step process the molten imidazoline is added to the acid/water seat under high shear mixing. The pH of this dispersion is from 2.5 to 6, preferably from 3 to 5.

U.S. Pat. No. 4,724,089, Konig et al., issued Feb. 9, 1988, P&G, teaches a rinse-added fabric softener composition comprising imidazoline and a Bronstedt acid as a dispersion aid. In a one-step process molten imidazoline is added to an acid/water seat of sufficient acid concentration to keep the pH at 5 or below.

U.S. Pat. No. 4,806,255, Konig et al., issued Feb. 21, 1989, teaches rinse-added fabric softener compositions comprising an amine, including imidazoline, a quaternary ammonium softening agent, with an optional Bronstedt acid as a dispersing aid.

U.S. Pat. No. 4,661,267, Dekker et al., issued Apr. 28, 1987, discloses a rinse-added fabric softener composition comprising a cyclic amine such as imidazoline, and a soil release polymer, with a pH range of 2 to 6.5. A Bronstedt acid is optional.

European Pat. Appln. No. 409,503, Tandela, published Jan. 23, 1991, describes fabric softening compositions comprising an amine softener, including imidazoline, a fatty acid, and a buffer acid.

European Pat. Appln. No. 404,471, Machin et al., published Dec. 27, 1990, discloses concentrated fabric softening compositions with at least 20% by weight of the fabric softener active, including imidazoline, and at least 5% by weight of an organic acid preferably between 15–30% by weight of the composition with improved stability and appearance. The composition's pH is between 2 and 5.

E.P.A. No. 443,313, published Aug. 28, 1991, teaches the addition of a neutralizing acid to an esteramine material for improved dispersibility in rinse water and softening benefits.

It is highly desirable to prepare physically-acceptable textile treatment compositions containing biodegradable, water-insoluble, softener materials that exhibit excellent softening performance. However, materials which are biodegradable are often difficult to formulate as stable liquid compositions, especially at high concentrations. Various solutions in the art have not been entirely satisfactory.

It is a preferred object of this invention to provide an effective, storage-stable, preferably biodegradable, liquid fabric softening composition. It is a further object to provide such materials in the form of liquid concentrates.

All of the above patents, patent applications, and publications are incorporated herein by reference.

SUMMARY OF THE INVENTION

The present invention comprises a novel three-step method for making aqueous shelf-stable, preferably biodegradable, fabric softening compositions.

Step (1) comprises heating an active premix which contains a substituted imidazoline compound, and optionally a soil release polymer and a scum dispersant, to a temperature at or above the melting point(s) of these components to form a fluidized melt and thereafter, Step 2 (alternatively):

(a) adding the fluidized melt to an acid/water seat having sufficient acid to fully protonate the substituted imidazoline compound; or (b) adding sufficient acid to fully protonate the substituted imidazoline compound directly to the fluidized melt.

Typically the acid concentration in the acid/water seat is from about 4% to about 7%, preferably from about 4.8% to about 6.6%. The addition of the fluidized melt to the acid/water seat results in a super concentrate having from about 35% to about 55% by weight of imidazoline compound. The volume of water in the acid/water seat is about $\frac{1}{3}$ to about $\frac{2}{3}$ preferably from about 2/5 to about 3/5 of the total volume of water in the finished softener composition. The temperature of the acid/water seat is from about 155° F. (68° C.) to about 195° F. (91° C.).

If the acid is added directly to the fluidized melt, the resulting super concentrate has from about 78% to about 87% by weight substituted imidazoline compound.

Typically, the molar ratio of the acid to substituted imidazoline compound is from about 1:0.67 to about 1:1.10, preferably from about 1:0.83 to about 1:1, more preferably from about 1:0.91 to about 1:0.96.

In Step (3), to achieve the final desired imidazoline softener concentration of from about 9% to about 40% by weight, the concentrate of Step (2) is diluted with additional water which is from about $\frac{1}{3}$ to about $\frac{2}{3}$, preferably from about 2/5 to about 3/5 of the total volume of water in the finished softener composition. This diluting water has a temperature of from about 50° F. (10° C.) to about 195° F. (91° C.), preferably about 155° F. (68° C.) to about 185° F. {85° C.). Optionally, the diluting water may contain electrolyte such as $CaCl_2$. The molar ratio of acid to substituted imidazoline, preferably, remains constant. Throughout all three steps the composition is mixed with a high shear mixer to form a homogeneous mixture with the imidazoline softening compound having a particle size of from about 0.1 to about 1 micron, preferably from about 0.1 to 0.5 micron, more preferably from about 0.1 to 0.3 micron. The pH of the final composition is from about 1.5 to about 4, preferably from about 2 to about 3.

All percentages, ratios and proportions herein are by weight, unless otherwise specified. All numbers are approximations unless otherwise stated.

DETAILED DESCRIPTION OF THE INVENTION

Substituted Imidazoline Softening Compound

Compositions prepared by the present invention contain as an essential component from about 9% to about 40%, preferably from about 9% to about 30%, of substituted imidazoline fabric softener material, typically consisting essentially of a substituted imidazoline softening compound having the formula:

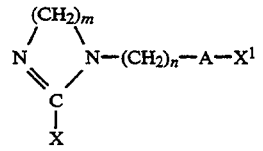

wherein each A is either —N(R)C(O)—, —OC(O)—, or a single covalent bond, preferably —OC(O)— and R is a $C_1$–$C_6$ alkyl, alkenyl, hydroxy alkyl or hydrogen; X and $X^1$ are, independently, hydrocarbyl, preferably alkyl, groups containing from about 11 to about 31, preferably from about 13 to about 17, carbon atoms, more preferably straight chain alkyl, and m and n are, independently, from about 2 to about 4, preferably with both m and n being 2. The total concentration of softener active should not exceed about 40% by weight It will be understood that substituents X and $X^1$ can optionally be substituted with various groups such as alkoxyl or hydroxyl, or can be branched, but such materials are not preferred herein. In addition X and/or $X^1$ can optionally be unsaturated (i.e., alkenyl groups). The preferred substituted imidazoline ester softening compounds will hereinafter be referred to as di-alkyl imidazoline ester compounds.

The above compounds used as the primary active softener ingredient in the practice of this invention are prepared using standard reaction chemistry. Disclosure of imidazoline fabric softener compounds useful herein can be found in U.S. Pat. Nos.: 4,661,267, Dekker, Konig, Straathof, and Gosselink, issued Apr. 28, 1987; 4,724,089, Konig and Buzzaccarini, issued Feb. 9, 1988; 4,806,255, Konig and Buzzaccarini, issued Feb. 21, 1989; 4,855,072, Trinh, Wahl, Swartley, and Hemingway, issued Aug. 8, 1989; 4,933,096, DeMeyere, Hardy, and Konig, issued Jun. 12, 1990; and 4,954,635, Rosario-Jansen and Lichtenwalter, issued Sep. 4, 1990; all of said patents being incorporated herein by reference.

For example, in a typical synthesis of a substituted imidazoline ester softening compound of formula above, a fatty acid of the formula XCOOH is reacted with a hydroxyalkylenediamine of the formula $NH_2$—$(CH_2)m$—NH—$(CH_2)_nOH$ to form an intermediate imidazoline precursor, which is then reacted with a methyl ester of a fatty acid of the formula:

$X^1C(O)OCH_3$ to yield the desired reaction product (wherein X, $X^1$, m and n are as defined above). It will be appreciated by those of ordinary skill in the chemical arts that this reaction sequence allows a broad selection of compounds to be prepared. As illustrative, nonlimiting examples there can be mentioned the following di-alkyl imidazoline esters (wherein all long-chain alkyl substituents are straight-chain)): 1-stearyl oxyethyl-2-stearyl imidazoline, 1-stearyl oxyethyl-2-palmityl imidazoline, 1-stearyl oxyethyl-2-myristyl imidazoline, 1-palmityl oxyethyl-2-palmityl imidazoline, 1-palmityl oxyethyl-2-myristyl imidazoline, 1-stearyl oxyethyl-2-tallow imidazoline, 1-myristyl oxyethyl-2-tallow imidazoline, 1-palmityl oxyethyl-2-tallow imidazoline, 1-coconut oxyethyl-2-coconut imidazoline, 1-tallow oxyethyl-2-tallow imidazoline, and mixtures of such imidazoline compounds.

Other types of substituted imidazoline softening compounds can also be used herein. Examples of such compounds include:

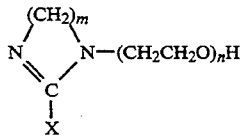
(i)

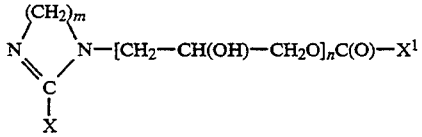
(ii)

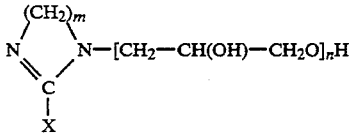
(iii)

wherein X, $X^1$, m and n are as previously defined. The above list is intended to be illustrative of other types of substituted imidazoline softening compounds which can optionally be used in the present invention, but which are not preferred.

The Acid Component

The process of the present invention utilizes an acid of sufficient concentration to fully protonate the substituted imidazoline compound. In Step (2) of the process the fluidized melt defined hereinbefore is either added to an acid/water seat or the acid is added directly to the fluidized melt. Typically the acid/water seat has an acid concentration of from about 4% to about 7%, preferably from about 4.8% to about 6.6%. The addition of the fluidized melt to the acid/water seat results in a super concentrate having from about 35% to about 55% by weight of the substituted imidazoline compound. The volume of water in the acid water seat is about ⅓ to about ⅔, preferably from about 2/5 to about 3/5, of the total volume of water in the finished softener composition. The temperature of the acid/water seat is from about 155° .F (68° C.) to about 195° F. (91° C.).

If the acid is added directly to the fluidized melt, the resulting super concentrate has from about 78% to about 87% by weight imidazoline.

Typically, the acid to substituted imidazoline compound molar ratio is from about 1:0.67 to about 1:1.10, preferably from about 1:0.83 to about 1:1, more preferably from about 1:0.91 to about 1:0.96. This molar ratio will remain constant throughout all steps of the process.

The pH of the final composition is from about 1.5 to about 4, preferably from about 2 to about 3.

Suitable acids include inorganic mineral acids and organic acids such as carboxylic acids. Carboxylic acids include, in particular, the low molecular weight ($C_1$–$C_5$) carboxylic acids of the formula R-COOH (R being a $C_1$–$C_5$ alkyl group). Suitable organic acids are selected from the group having the formula $RCH_2SO_3H$, wherein R is hydrogen or $C_1$ to $C_4$ alkyl. Other suitable organic acids include formic, methylsulfonic, ethylsulfonic, citric, gluconic, and aromatic carboxylic acids like benzoic acid. Suitable inorganic acids include HCl, HBr, $H_2SO4$, $H_2SO_3$, $HNO_3$, and $H_3PO_4$.

Preferred acids are phosphoric, formic, acetic, hydrochloric, citric, and methylsulfonic acid. Mixtures of the above organic and inorganic acids are also suitable. Typically acids such as citric, hydrochloric, phosphoric and sulfuric are used because of their low cost and availability.

Liquid Carrier

The compositions prepared by the process of the present invention herein comprise of from about 60% to about 90%, preferably from about 70% to about 90% of an aqueous liquid carrier.

In Step (2) of the process the fluidized melt defined hereinbefore is either added to an acid/water seat or the acid is added directly to the fluidized melt. Typically the acid/water seat has an acid concentration of from about 4% to about 7%, preferably from about 4.8% to about 6.6%. The addition of the fluidized melt to the acid/water sear results in a super concentrate having from about 35% to about 55% by weight of the substituted imidazoline compound. The volume of water in the acid water seat is about ⅓ to about ⅔, preferably from about 2/5 to about 3/5 of the total volume of water in the finished softener composition. The temperature of the acid/water seat is from about 155° F. (68° C.) to about 195° F. (91° C.).

If the acid is added directly to the fluidized melt, the resulting super concentrate has from about 78% to about 87% be weight imidazoline.

By minimizing the volume of water in the second step, the process provides more rapid and complete protonation of the substituted imidazoline compound.

Typically, the acid to substituted imidazoline compound molar ratio is from about 1:0.67 to about 1:1.10, preferably from about 1:0.83 to about 1:1, more preferably from about 1:0.91 to about 1:0.96. This molar ratio will remain constant throughout all steps of the process.

In Step (3), to achieve the final desired imidazoline softener concentration of from about 9% to about 40% by weight, the concentrate of Step (2) is diluted with additional water which is from about ⅓ to about ⅔, preferably from about 2/5 to about 3/5 of the total volume of water in the finished softener composition. This diluting water has a temperature of from about 50° F. (10° C.) to about 195° F. (91° C.), preferably about 155° F. (68° C.) to about 185° F. (85° C.). Optionally, the diluting water may contain electrolyte such as $CaCl_2$.

Preferably, the addition of water in Step (3) is achieved by adding the remaining volume of water in from about 1 to about 5 equal volume aliquots, preferably from about 2 to about 3 equal volume aliquots. After all remaining water is added, the softener dispersion is cooled to a temperature of from about 77° F. (25° C.) to about 86° F. (30° C.).

The imidazoline softening compounds used in this invention are insoluble in such water-based carriers and, thus, are present as a dispersion of fine particles therein. These particles are submicron, preferably having diameters of from about 0.1 to about 1 micron, preferably from 0.1 to 0.5 micron, more preferably from 0.1 to 0.3 micron. These submicron particles are conveniently prepared by high-shear mixing which disperses the compounds as fine particles. An appropriate high shear mixer is made by Tekmar, but any high shear mixer that will produce the particle sizes as stated above will suffice. Preferably high shear mixing is conducted during Steps (1), (2) and (3) to produce homogeneous mixing and appropriate particle sizes throughout the process.

Again, since the preferred ester softening compounds are hydrolytically labile, care should be taken to avoid the presence of base with such compounds, and to keep the processing temperatures and pH within the ranges specified herein.

Optional Ingredients

Fully-formulated fabric softening compositions made by the process of the present invention can optionally contain, in addition to the biodegradable, substituted imidazoline ester softening compounds of the formulas herein, protonating acid and an aqueous liquid carrier, one or more of the following ingredients.

Silicone Component

The fabric softening compositions herein optionally contain an aqueous emulsion of a predominantly linear polydialkyl or alkyl aryl siloxane in which the alkyl groups can have from one to five carbon atoms and can be wholly, or partially, fluoridated. These siloxanes act to provide improved fabric benefits. Suitable silicones are polydimethyl siloxanes having a viscosity, at 25° C., of from about 100 to about 100,000 centistokes, preferably from about 1,000 to about 12,000 centistokes. In some applications as low as 1 centistoke materials are preferred.

The fabric softening compositions herein can contain up to about 15%, preferably from about 0.1% to about 10%, of the silicone component.

Thickening Agent

Optionally, the compositions herein contain from 0% to about 3%, preferably from about 0.01% to about 2%, of a thickening agent. Examples of suitable thickening agents include: cellulose derivatives, synthetic high molecular weight polymers (e.g., carboxyvinyl polymer and polyvinyl alcohol), and cationic guar gums.

The cellulosic derivatives that are functional as thickening agents herein can be characterized as certain hydroxyethers of cellulose, such as Methocel ®, marketed by Dow Chemicals, Inc.; also, certain cationic cellulose ether derivatives, such as Polymer JR-125 ®, JR-400 ®, and JR-30M ®, marketed by Union Carbide.

Other effective thickening agents are cationic guar gums, such as Jaguar Plus ®, marketed by Stein Hall, and Gendrive ® 458, marketed by General Mills.

Preferred thickening agents herein are selected from the group consisting of methyl cellulose, hydroxypropyl methylcellulose, hydroxybutyl methylcellulose, or mixtures thereof, said cellulosic polymer having a viscosity in 2% aqueous solution at 20° C. of from about 15 to about 75,000 centipoises.

Viscosity Control Agents

Viscosity control agents can be used in the compositions of the present invention (preferably in concentrated compositions). Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts include sodium citrate and the halides of the group IA and IIA metals of the Periodic Table of the Elements, e.g., calcium chloride, magnesium chloride, sodium chloride, potassium bromide and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator.

In addition to their role as viscosity agents, the ionizable salts mentioned above also function as electrolytes and can further improve the stability of the compositions herein. A highly preferred electrolyte is calcium chloride.

Typical levels of use of the electrolyte are from about 20 to about 15,000 parts per million (ppm), preferably from about 20 to about 10,000 ppm by weight of the compositions. Maximum electrolyte levels of 6,000 ppm and 4,000 ppm are desirable for some compositions.

Soil Release Agent

In Step (1) of the present invention the substituted imidazoline can be mixed with an optional soil release agent and heated to a temperature at or above the melting point(s) of these components. The compositions prepared by the process of the present invention herein can contain from 0% to about 10%, preferably from about 0.2% to about 5%, of a soil release agent. Preferably, such a soil release agent is a polymer. Polymeric soil release agents useful in the present invention include copolymeric blocks of terephathalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terphthalate units, derived from a polyoxyethylene glycol of average molecular weight of from about 300 to about 6,000, and the molar ratio of ethylene terephthalate containing polyethylene oxide blocks having molecular weights of from about 300 to about 2,000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon ® 4780 (from DuPont) and Milease ® T (from ICI).

Highly preferred soil release agents are polymers of the generic formula:

$$X-(OCH_2CH_2)_n(O-\overset{O}{\overset{\|}{C}}-R^1-\overset{O}{\overset{\|}{C}}-OR^2)_u(O-\overset{O}{\overset{\|}{C}}-R^1O\overset{O}{\overset{\|}{C}}-O)(CH_2CH_2O)_n-X$$

in which X can be suitable capping group, with each X being selected from the group consisting of H, and alkyl or acyl groups containing from about 1 to about 4 carbon atoms. n is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1, 4-phenylene moieties. As used herein, the term the $R^1$ moieties are essentially 14-phenylene moieties refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4 phenylene include 1,3-phenylene, 1,2-phenylene, 1,8-naphthylene, 1,4-napthylene, 2,2-biphenylene, 4,4-biphenylene and mixtures therof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 14-phenylene moieties from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixtures thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100);, more preferably from about 90); to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of soil release agents is contained in U.S. Pat. Nos.: 4,711,730, Gosselink and Diehl, issued Dec. 8, 1987; 4,749,596, Evans, Huntington, Stewart, Wolf, and Zimmerer, issued Jun. 7, 1988; 4,818,569, Trinh, Gosselink, and Rattinger, issued Apr. 4, 1989; 4,877,896, Maldaonado, Trinh, and Gosselink, issued Oct. 31, 1989; 4,956,447, Gosselink et al., issued Sep. 11, 1990; and 4,976,879, Maldonado, Trinh, and Gosselink, issued Dec. 11, 1990, all of said patents being incorporated herein by reference.

Scum Dispersant Material

In Step (1) of the present invention the substituted imidazoline can be mixed with an optional scum dispersant material, other than the soil release agent, and heated to a temperature at or above the melting point(s) of these components.

The scum dispersant materials herein are formed by highly ethoxylating hydrophobic materials. The hydrophobic material can be a fatty alcohol, fatty acid, fatty amine, fatty acid amide, amine oxide, quaternary ammonium compound, and/or the hydrophobic moeities used to form soil release polymers. The preferred materials are highly ethoxylated, e.g., more than about 17, preferably more than about 25, more preferably more than about 40, moles of ethylene oxide per molecule on the average, with the polyethylene oxide portion being from about 76% to about 17%, preferably from about 81% to about 94%, of the total molecular weight.

The level of scum dispersant is sufficient to keep the scum at an acceptable, preferably unnoticeable to the consumer, level under the conditions of use, but not enought to adversely affect softening. For some purposes it is desirable that the scum is nonexistent. Depending upon the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and/or detergency builder (especially phosphates) entrapped in the fabric (laundry) will vary. Normally, the minimum amount of scum dispersant material should be used to avoid adversely affecting softening properties. Typically scum dispersion requires at least about 2%, preferably at least about 4% (at least 6% and at least 10% for maximum scum avoidance) based upon the level of the substituted imidazoline fabric softener material. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij ®700; Varonic-®U-250; Genapol ®T-S00, Genapol ®T-B00; Plurafac ®A-79; and Neodol ® 25-50. Other suitable scum dispersants are disclosed in copending application Ser. No. 07/693,493, Vogel, Watson, Wahl, and Benvegnu, filed Apr. 30, 1991, incorporated herein by reference.

Bactericides

Examples of bactericides used in the compositions of this invention include glutaraldehyde, formaldehyde, 2-bromo-2-nitropropane-1,3-diol sold by Inolex Chemicals, located in Philadelphia, Pa., under the trade name Bronopol ®, and a mixture of 5-chloro-2-methyl-4-isothiazoline-3-one and 2-methyl-4-isothiazoline-3-one sold by Rohm and Haas Company under the trade name Kathon ®CG/ICP. Typical levels of bactericides used in the present compositions are from about 1 to about 1,000 ppm by weight of the composition.

Other Optional Ingredient

The present invention can include other optional components conventionally used in textile treatment compositions, for example, colorants, perfumes, preservatives, optical brighteners, opacifiers, surfactants, stabilizers such as guar gum and polyethylene glycol, anti-shrinkage agents, anti-wrinkle agents, fabric crisping agents, spotting agents, germicides, fungicides, anti-oxidants such as butylated hydroxy toluene, anti-corrosion agents, and the like.

The compositions of the present invention are preferably used in the rinse cycle of the conventional automatic laundry operations. Generally, rinse water has a temperature of from about 15° C. to about 60° C.

Fabrics or fibers are contacted with an effective amount, generally from about 20 ml to about 300 ml (per 3.5 kg of fiber or fabric being treated), of the compositions herein in an aqueous bath. Of course, the amount used is based upon the judgment of the user, depending on concentration of the composition, fiber or fabric type, degree of softness desired, and the like. Typically, from about 20 ml to about 300 ml of an 9% to 40% dispersion of the softening compounds are used in a 25 gallon laundry rinse bath to soften and provide antistatic benefits to a 3.5 kg load of mixed fabrics. Preferably, the rinse bath contains from about 200 ppm to about 1,000 ppm of the fabric softening compositions herein. These concentration levels achieve superior fabric softening and static control.

The following example illustrates the methods of this invention and the benefits achieved by the utilization of these methods. The invention is not limited to this example.

EXAMPLE I

| Ingredient | Percent (Wt.) |
|---|---|
| DTIE[1] | 23.60 |
| Tallow Alcohol Polyethoxylate (50) | 1.00 |
| Polyethoxylate Polyester Soil Release Polymer[2] | 0.75 |
| HCl | 1.58 |
| Dye Solution | 0.04 |
| Perfume | 1.20 |
| DC-200 Silicone[3] | 0.19 |
| Antifoam[4] | 0.04 |
| $CaCl_2$ | 1.10 |
| Deionized Water and Minor Ingredients | 70.50 |

[1]Ditallowalkyl imidazoline ester.
[2]Copolymer of ethylene oxide and terephthalate.
[3]Dow Corning Silicone having viscosity of 1 cs.
[4]Dow Corning Antifoam 2210.

Based on 1 000 g of finished product, 236 g of the biodegradable dialkyl imidazoline ester softening compound, 10 g of the tallow alcohol polyethoxylate (50), and 7.5 g polyethoxylate polyester soil release polymer are heated to 80° C. and mixed to form a fluidized "melt." The molten mixture is added to a 300 g water seat, preheated to 75° C. and containing 15.8 g HCl and 0.4 g antifoam, with high shear mixing over 6 minutes. After additional mixing time, 12.0 g perfume and 1.g g silicone oil are mixed together and added at 65°-70° C. The remaining 372 g of water at a temperature of 80°-85° C. is then added in 3 aliquots, alternately with 3 aliquots of a 25% solution of $CaCl_2$ of sufficient quanity to provide a thin composition. The dispersion is mixed for 2.5 minutes at 6000 rpm (Ika Model RW20 DZM high shear mixer). The product is then cooled to 25°-30° C. and 0.4 g dye solution is added after cooling. The resulting dispersion will have a viscosity of about 60-80 cps and a pH of about 2 0 at 25° C. The average particle size in the dispersion is about 0.2 micron.

What is claimed is:

1. A method for preparing aqueous, biodegradable, shelf-stable fabric softening compositions comprising the steps of:

(1) heating a substituted imidazoline compound to a temperature at or above its melting pint to form a fluidized melt;

(2) forming a concentrate by either (a) adding the fluidized melt to an acid/water seat having a sufficient acid concentration to create an acid to imidazoline molar ratio to fully protonate the substituted imidazoline compound; or (b) adding acid directly to the fluidized melt to create an acid to imidazoline molar ratio to fully protonate the substituted imidazoline compound;

(3) diluting the concentrate form (2) with additional water having a temperature of from about 50° F. (10° C.) to about 195° F. (91° C.); wherein the fabric softening composition has a concentration of from about 9% to about 40% by weight of imidazoline and an average particle size of from about 0.1 to about 1 micron;

and wherein the weight % of the acid in the water seat prior to the addition of the fluidized melt is from about 4% to about 7%, and wherein the substituted imidazoline compound has the formula:

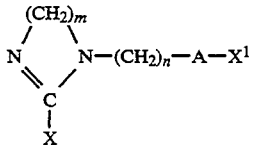

wherein: each A is either (1) —N(R)C(O)—, or (2) —O—C(O)—, or (3) a single covalent bond, R is a $C_1$-$C_6$ alkyl, alkenyl, hydroxy alkyl or hydrogen, X and $X^1$ are, independently, $C_{11}$-$C_{31}$ hydrocarbyl groups; and m and n are, independently, from 2 to 4.

2. The method according to claim 1 wherein the acid to imidazoline molar ratio is from about 1:0.67 to about 1:1.10.

3. The method according to claim 2 wherein the acid is selected from the group consisting of mineral acids and organic acids of the formula RCOOH or $RCH_2SO_3H$, wherein R is hydrogen or $C_1$ to $C_4$ alkyl; and mixtures thereof.

4. A method according to claim 3, wherein the acid is phosphoric acid hydrochloric acid citric acid, and mixtures thereof.

5. The method according to claim 3 wherein the fabric softening composition has a pH of from about 1.5 to about 4.

6. The method according to claim 1 wherein the concentration of the final composition is from about 9% to about 30% by weight of the substituted imidazoline compound having the formula:

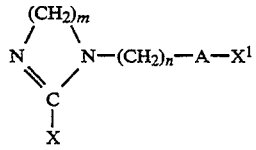

wherein: each A is either (1) —N(R)C(O)—, or (2) —O—C(O)—, or (3) a single covalent bond, R is a $C_1$-$C_6$ alkyl, alkenyl, hydroxy alkyl or hydrogen X and $X^1$ are, independently, $C_{11}$-$C_{21}$ hydrocarbyl groups; and m and n are, independently, from 2 to 4.

7. A method for preparing aqueous, biodegradable, shelf-stable fabric softening compositions comprising the steps of:

(1) heating a substituted imidazoline compound to a temperature at or above its melting point to form a fluidized melt;

(2) forming a concentrate by either (a) adding the fluidized melt to an acid/water seat having a sufficient acid concentration to create an acid to imidazoline molar ratio to fully protonate the substituted imidazoline compound; or (b) adding acid directly to the fluidized melt to create an acid to imidazoline molar ratio to fully protonate the substituted imidazoline compound:

(3) diluting the concentrate from (2) with additional water having a temperature of from about 50° F. (10° C.) to about 195° F. (91° C.); wherein the fabric softening composition has a concentration of from about 9% to about 30% by weight of imidazoline and an average particle size of from about 0.1 to about 1 micron;

and wherein the weight % of the acid in the water seat prior to the addition of the fluidized melt is from about 4.8% to about 7%, wherein the substituted imidazoline compound has the formula:

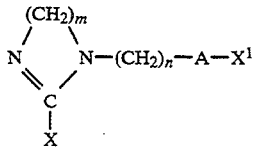

wherein: each A is either (1) —N(R)C(O)—, or (2) —O—C(O)—, or (3) a single covalent bond, R is a $C_1$-$C_6$ alkyl, alkenyl, hydroxy alkyl or hydrogen, X and $X^1$ are, independently, $C_{11}$-$C_{21}$ hydrocarbyl groups; and m and n are, independently, from 2 to 4.

8. The method according to claim 6 wherein the acid to imidazoline molar ratio is from about 1:0.83 to about 1:1.

9. The method according to claim 8 wherein the acid is selected from the group consisting of mineral acids and organic acids of the formula RCOOH or $RCH_2SO_3H$, wherein R is hydrogen or $C_1$ to $C_4$alkyl; and mixtures thereof.

10. The method according to claim 9 wherein the acid is phosphoric acid, hydrochloric acid,citric acid, and mixtures thereof.

11. The method according to claim 8 wherein the fabric softening composition has a pH of form about 2 to about 3.

12. The method according to claim 1 wherein the concentration of the final composition is from about 9% to about 30% by weight of the substituted imidazoline compound having the formula:

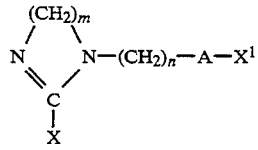

wherein A is —OC(O)—, X and $X^1$ are, independently, $C_{13}$-$C_{17}$ hydrocarbyl groups, and m and n are 2.

13. The method according to claim 12, wherein the acid to imidazoline molar ratio is from about 1:0.91 to about 1:0.96.

14. The method according to claim 13 wherein the acid is selected from the group consisting of mineral acids and organic acids of the formula RCOOH or $RCH_2SO_3H$, wherein R is hydrogen or $C_1$ to $C_4$ alkyl; and mixtures thereof.

15. The method according to claim 14 wherein the acid is phosphoric acid, hydrochloric acid, citric acid, and mixtures thereof.

16. The method according to claim 13 wherein the aqueous fabric softener composition has a pH of from about 2 to about 3.

17. The method according to claim 13 wherein the fabric softening composition has a pH of from about 2 to about 3.

18. A method for preparing aqueous, biodegradable, shelf-stable fabric softening compositions comprising the steps of:

(1) heating a substituted imidazoline compounds to a temperature at or above its melting point to form a fluidized melt;

(2) forming a concentrate by either (a) adding the fluidized melt to an acid/water seat having a sufficient acid concentration to create an acid to imidazoline molar ratio to fully protonate the substituted imidazoline compound; or (b) adding acid directly to the fluidized melt to create an acid to imidazoline molar ratio to fully protonate the substituted imidazoline compound;

(3) diluting the concentrate from (2) with additional water having a temperature of from about 50° F. (10° C.) to about 195° F. (91° C.); wherein the fabric softening composition has a concentration of from about 9% to about 30% by weight of imidazoline and has an average particle size of from about 0.1 to about 1 micron;

and wherein the weight % of the acid in the water seat prior to the addition of the fluidized melt is from about 4% to about 7%, wherein the substituted imidazoline compound has the formula

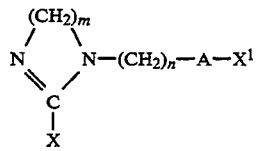

wherein: each A is —O—C(O)—, X and $X^1$ are, independently, $C_{13}$–$C_{17}$ hydrocarbyl groups; and m and n are 2; and wherein a soil release polymer and a scum dispersant are heated with said substituted imidazoline in Step (1).

* * * * *